United States Patent [19]

George

[11] 4,304,498

[45] Dec. 8, 1981

[54] GUTTER CLEANING APPARATUS

[76] Inventor: Michael F. George, 782 Loch Lomond La., Worthington, Ohio 43085

[21] Appl. No.: 178,151

[22] Filed: Aug. 14, 1980

[51] Int. Cl.[3] ..... B05B 7/06

[52] U.S. Cl. ..... 401/9; 401/28; 401/139; 401/266; 239/532; 134/167 C; 52/16; 15/160

[58] Field of Search ..... 401/9–11, 401/15, 28, 48, 137, 139, 193–195, 261, 263, 265, 266; 239/532; 134/167 C, 168 C; 15/160, 111, 144 R; 52/16

[56] References Cited

U.S. PATENT DOCUMENTS

| | | | |
|---|---|---|---|
| 2,019,372 | 10/1933 | Thurley | 401/48 |
| 2,720,409 | 10/1955 | Griffith | 15/144 B |
| 2,817,867 | 12/1957 | Bugbird | 15/160 |
| 3,023,971 | 3/1962 | Milhous | 239/532 |
| 3,143,984 | 8/1964 | Morasch | 401/263 |
| 3,377,123 | 4/1968 | Leeson | 401/139 |
| 3,858,267 | 1/1975 | Swannie | 15/144 R |
| 3,908,910 | 9/1975 | Detwiler | 239/532 |
| 4,150,793 | 4/1979 | Russo | 239/532 |

*Primary Examiner*—William Pieprz

*Attorney, Agent, or Firm*—Mueller and Smith

[57] ABSTRACT

Disclosed is a hand-held device for removing debris from a gutter. The device is operational from a location remote from the gutter and comprises a cleaning head which is removably attached to a handle.

9 Claims, 8 Drawing Figures

FIG. 1
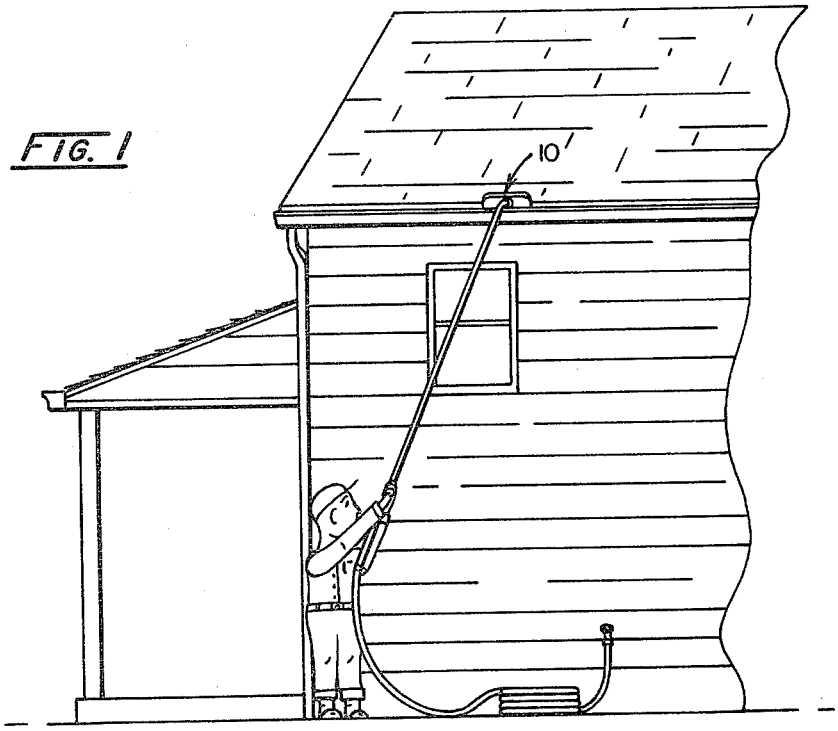
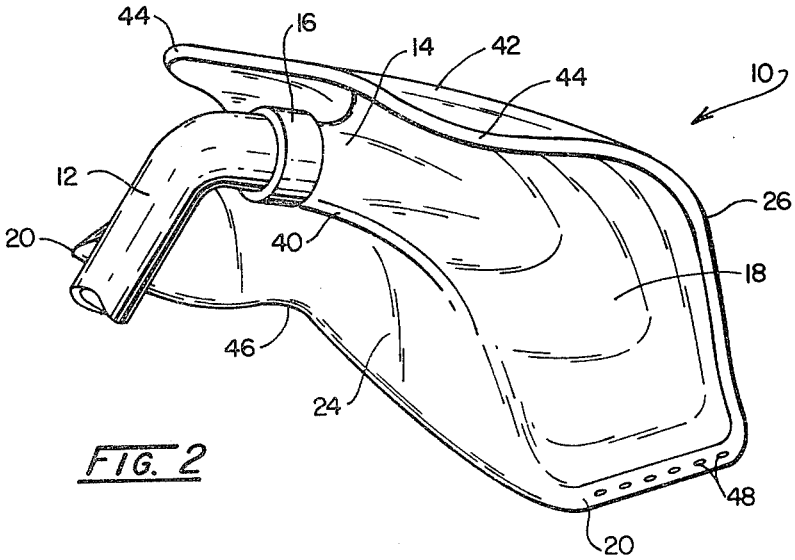
FIG. 2

FIG. 6
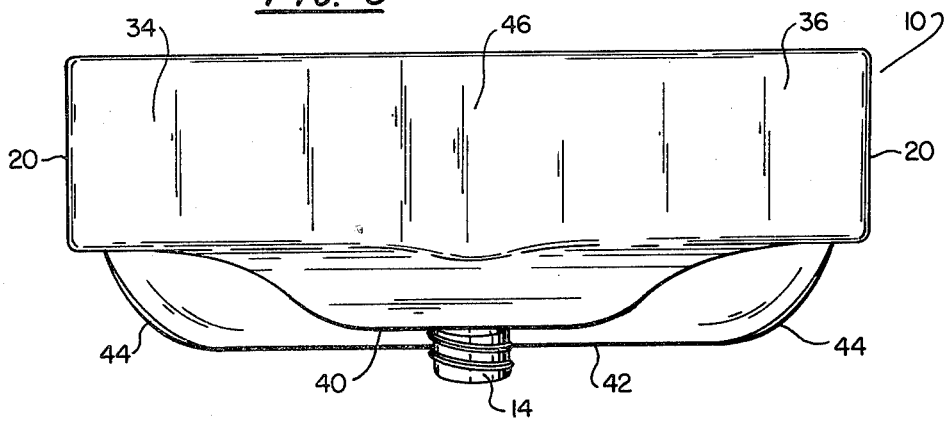
FIG. 7
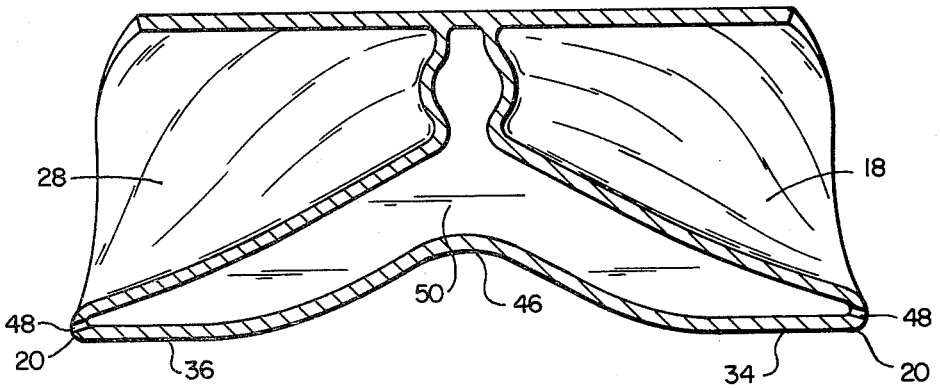
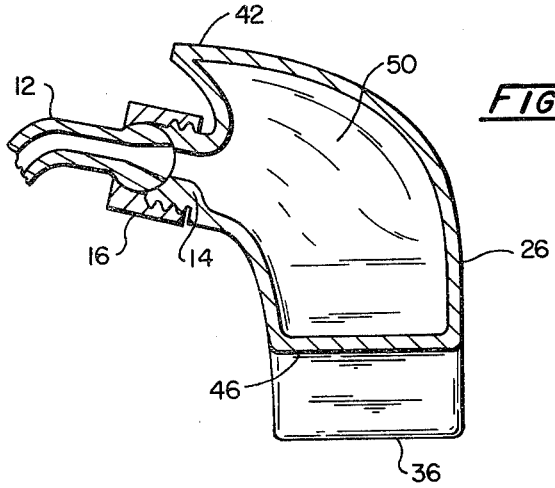
FIG. 8

GUTTER CLEANING APPARATUS

BACKGROUND OF THE INVENTION

The present invention relates to an apparatus especially adapted to remove debris from house gutters to effect their cleaning.

Gutters attached to houses, apartments, and buildings rapidly lose their water conveying function when the gutter trough becomes blocked or plugged by debris. Such debris not only retards the unrestricted flow of water therethrough but also can isolate sections of water in sections creating a pool ripe for breeding noxious insects. Further, such debris can become lodged in the mouth of the downspout even to such an extent that during heavy rains the water entirely fills the gutter and is forced to overflow the front edge of the gutter. Without a screen or similar device over the mouth of the downspout, the debris can additionally become lodged in the downspout to retard or totally prevent water from flowing therethrough. Debris typically found in gutters includes leaves, sticks, loose matter from shingles on the roof and the like.

The traditional manner in which gutters have been cleaned necessitates a person venturing up a ladder to physically remove the debris by hand or with the aid of a broom or similar device. On many occasions a hose is taken to the top of the ladder for throughly washing down and cleaning the gutter. The debris removed from the gutter most often merely is thrown down on the ground for collection later or can be placed in a bucket which must be suspended from the top of the ladder or held by the person cleaning the gutter. Unfortunately, many people each year are injured when they fall off the ladder while cleaning their gutters. Even should injury not befall the person cleaning the gutter, precarious positions often are required by the person in order to effectively clean the gutter while the person tries to simultaneously hold a bucket or like receptacle for placing the debris removed from the gutter, or using a broom or the like to try to push debris down the gutter to one end. Further complicating this seemingly simple procedure is the fact that the gutters are located on the eaves of the house which extend away from the wall of the house. This means that the ladder must be placed against the gutter which is not recommended as damage to the gutter can ensue thereby or the ladder must be placed up against the wall below the eave. In such a position, the person cleaning the gutter must assume an extremely precarious and awkward position on the ladder almost to an extent of leaning backwards from the house in order to reach the gutter for its cleaning. Moreover, since the person often is reaching over his head to clean the gutter and cannot see inside the gutter, a hornets' nest often is grasped unknowingly.

Though aids and devices have heretofor been proposed whereby the gutters can be cleaned from the ground, no such device has found any favor in the marketplace. The present invention now provides a simple and effective gutter cleaning apparatus which can be operated from the ground and which can be utilized for removing debris from the gutter and for washing down the trough of the gutter for its cleaning.

BROAD STATEMENT OF THE INVENTION

The present invention is a hand-held device for removing debris from gutters. The device is operational from a location remote from said gutter which location typically is the ground. The device comprises a cleaning head which is removably attached to a handle. The cleaning head has an interior sloping surface which slopes up from two side edges to a central upper extension connector. The sloping surface is defined by a front wall, a rear wall, and said connector. The front wall and the rear wall are adapted to substantially conformingly engage at least the lower sections of the front and rear walls of the gutter, respectively. The front wall has an upper sloping lip which extends over the front wall of the gutter and the rear wall has an upper sloping lip which extends towards and over said front wall lip and is in spaced-apart relationship from said front wall lip. Each side edge of the cleaning head has a substantially flat bottom to engage the bottom interior surface of the gutter, and each side edge is thin in heighth. The handle is removably attached to the central extension connector of the cleaning head and is of sufficient length to extend from the remote location to the gutter for operation of the device. The sloping surface of the cleaning head is adapted to transfer debris in the gutter from each side edge, up said surface, and over said front wall lip during movement of the cleaning head in the gutter while the rear wall and lip thereof and the central extension connector retain debris on the sloping surface.

The handle preferably is adapted about its lower end for a hose to be attached thereto, and such handle is hollow and capable of having water pass therethrough. Preferably the cleaning head also has water ducts therein which run from the central extension connector to openings at each side edge of the cleaning head, thereby permitting water to flow up said handle through said cleaning head and out said openings at each side edge for additional cleaning of the gutter. Additionally, the handle preferably is pivotably mounted to the central extension connector.

Advantages of the present invention include a uniquely designed cleaning head which effectively removes debris from gutters while being operated from the ground. Another advantage is that the handle can be pivoted about its attachment to the cleaning head so that the operator of the gutter cleaner can walk further away from the house around flower beds or bushes if required. A further advantage is that water can be squirted from the cleaning head to further clean the gutter. Such water flow additionally can be used to achieve a hydroplaning effect of the debris for effective transmission of the debris from the gutter trough to the gutter cleaner for its removal from the gutter. These and other advantages will become readily apparent to those skilled in the art based upon the disclosure herein contained.

BRIEF DESCRIPTION OF THE DRAWINGS

FIG. 1 shows the gutter cleaner in use cleaning a gutter on a house.

FIG. 2 is a perspective view of the cleaning head.

FIG. 6 is a bottom view of the cleaning head.

FIG. 7 is a sectional view of the cleaning head taken along line 7—7 of FIG. 5.

FIG. 8 is a sectional of the cleaning head taken along line 8—8 of FIG. 5 and shows an alternative central extension connector to the handle.

The drawings will be described in detail in connection with the detailed description of the invention which follows.

DETAILED DESCRIPTION OF THE INVENTION

Figure 3:
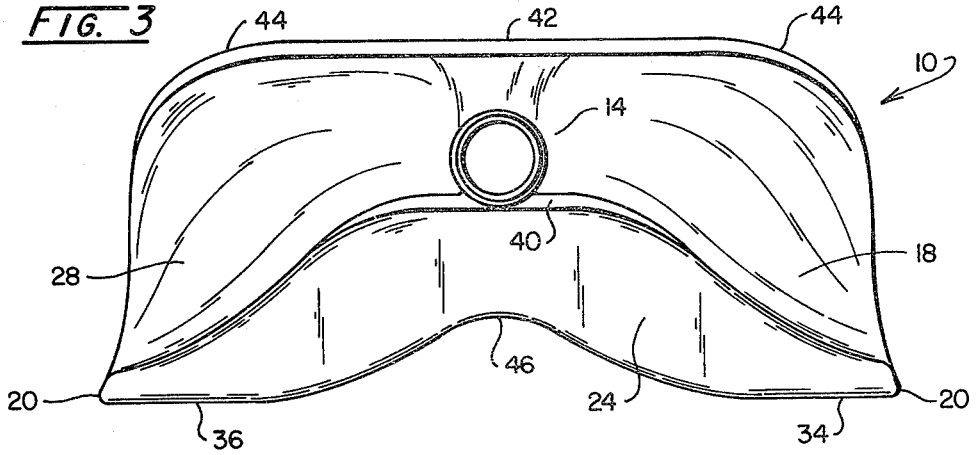
FIG. 3 is a side of the cleaning head.

Referring to FIG. 2, cleaning head 10 is shown attached to handle 12 at central extension connector 14 by means of nut 16. The upper section of handle 12 shown in FIG. 2 can be rigid or can be flexible. Interior sloping surface 18 slopes up from side edge 20 to central extension connector 14 on one side of the cleaning head and from the other side edge 22 (not shown in FIG. 2) to the other side of central extension connector 14. Interior sloping surface 18 is defined by front wall 24, rear wall 26, and central extension connector 14. An identical interior sloping surface 28 (see FIG. 3) is formed on the opposite side of central extension connector 14 shown in FIG. 2.

Figure 4:
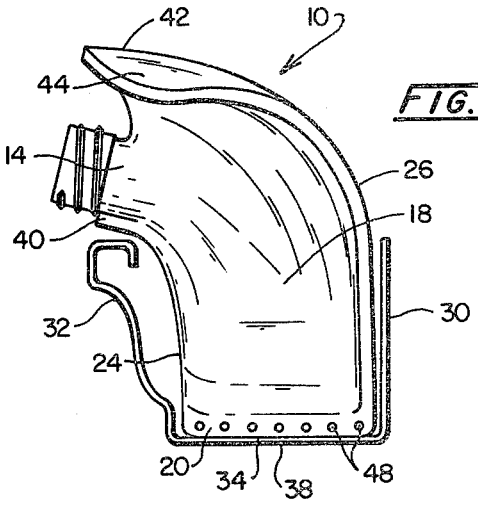
FIG. 4 is an end view of the cleaning head seated in a gutter.
Figure 5:
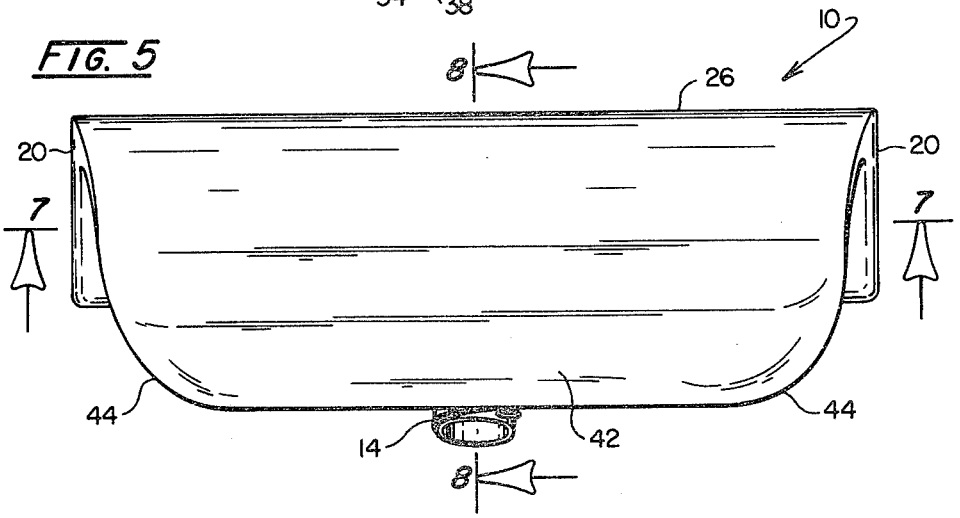
FIG. 5 is a top view of the cleaning head.

As shown in FIG. 4, rear wall 26 is adapted to substantially conformingly engage rear wall gutter wall 30 and front wall 24 is adapted to substantially conformingly engage at least the lower section of front gutter wall 32. Also, bottom area 34 and bottom area 36 about side edge 20 and side edge 22 (FIG. 3), respectively, are flat their entire width to substantially conformingly engage flat bottom interior surface 38 of the gutter. Thus, the arrangement of front wall 24, rear wall 26, and bottom areas 34 and 36 substantially preclude any debris in the gutter from bypassing movement up interior sloping surfaces 18 and 28 of cleaning head 10. For this purpose also, side edges 20 and 22 are thin in heighth so that debris can readily be transferred from the gutter to cleaning head 10.

Front wall 24 has upper sloping lip 40 which extends above gutter front wall 32. Rear wall 26 has upper sloping lip 42 which extends over upper sloping lip 40 of front wall 24 and is in spaced-apart relationship therefrom. The opening created between upper sloping lips 40 and 42 defines a passageway through which the debris transferred from the gutter up interior sloping surfaces 18 and 28 is discharged from cleaning head 10 and out of the gutter. In order to ensure that debris will be retained on interior sloping surfaces 18 and 28, upper sloping lip 42 of rear wall 26 has downward bent portions 44 (see FIGS. 2 and 6 also). The thus-created cavity is so designed that debris transferred from the gutter to interior sloping surfaces 18 and 28 will be forced to move up such surfaces and be discharged from cleaning head 10 via the opening between upper sloping lips 40 and 42.

Thus, operation of the gutter cleaning device of the present invention entails the lateral movement of the cleaning head in the gutter for transmission of the debris in the gutter over side edges 20 and 22 and up interior sloping surfaces 18 and 28 for discharge of such debris through the opening created between upper sloping lips 40 and 42. When the cleaning head comes to the gutter pins in the gutter, two features of cleaning head 10 enable the operator to continue cleaning around such gutter pin. The first feature is that the bottom of cleaning head 10 has inverted area 46 (FIG. 3) so that the cleaning head can be lifted up from the gutter and rotated about the gutter pin at inverted bottom area 46 with lateral movement of cleaning head 10 thence commencing with the other end of cleaning head 10 being then lowered back down into the gutter once such end clears the gutter pin. The other feature of cleaning head 10 involves the spraying of water from the cleaning head through ports 48 which are contained about side edges 20 and 22. Water exiting ports 48 can push debris out from underneath the gutter pin to an area of the gutter at which cleaning head 10 can be used for its removal. As to the water system contained in the gutter cleaning device of the present invention, handle 12 is adapted about its lower end for having a conventional garden hose or similar water carrying device attached thereto, such as shown in FIG. 1. Handle 12 may be telescoping, of one-piece construction, or several sections which can be screwed or snapped together to achieve any desired length. Desirably, an on-off and flow control switch is provided at the lower end of handle 12 so that the flow of water into the device can be controlled. Handle 12, then, preferably is hollow so that water can be transferred therethrough. As can be seen in FIG. 7, for example, the interior of cleaning head 10 is hollow for water to flow therethrough. Ports 48 at each side edge 20 and 22 discharge the water from cavity 50 within cleaning head 10. Desirably, ports 48 are adapted to direct the water in a downward direction against the floor of the gutter so as to lift or float the debris on a thin layer of water. Such hydroplaning effect of the debris enhances the transferrance of the debris from the gutter onto interior sloping surfaces 18 and 28 of cleaning head 10. Additionally, the flow of water cleans dirt and similar small particles from the gutter and washes them down the downspout connected thereto. The loosening of the debris and hyroplaning effect thereof created by the unique water system of the gutter cleaning device of the present invention enables the operator of the device to clean gutters readily and efficiently from debris.

Another feature of the present invention which permits the operator of the device to walk around flower beds, shrubs, and the like which often are adjacent houses is the preferable rotatable or pivotable connection of handle 12 to cleaning head 10. This can be accomplished by having a short upper section of handle 12 about its connection to cleaning head 10 be made of flexible material. Alternatively and preferably, though, a ball and socket arrangement as shown in FIG. 8 is utilized. As shown at FIG. 8, hollow handle 12 at its upper end has a hollow ball which is placed into the socket-like area of central extension connector 14 and secured thereto via nut 16. Nut 16 can be secured to central extension connector for locking handle 12 in any desired position or can be slightly loosened so that handle 12 can be rotated and pivoted about its connection to cleaning head 10 for permitting the operator of the device to walk parallel along with the gutter for its cleaning while simultaneously veering his perpendicular distance from the house to walk around flower beds, shrubs, and similar obstacles typically found around houses.

Further desirable features which can be adapted to the gutter cleaning device of the present invention includes the use of brush-like means which can be attached to side edges 20 and 22 for cleaning of the gutter and a valve means located on cleaning head 10 which can be adjusted into a position whereby water will flow only out ports 48 of side edge 20, only out of ports 48 of side edge 22, or out of ports 48 of both side edges 20 and 22 simultaneously.

Materials of construction for the gutter cleaning device of the present invention desirably are plastic and preferably high-impact plastic which can be suitably injection molded or otherwise formed into the design of handle 12 and cleaning head 10 of the gutter cleaning device of the present invention. Alternatively, aluminum or similar lightweight construction material, including fiberglass or other reinforced plastic, can be used. It is desirable, though, that materials of construction be extremely light in weight since the operator must balance the weight of cleaning head 10 and handle 12 from a location remote from the gutter.

I claim:

1. A hand-held device for removing debris from gutters which device is operational from a location remote from said gutter which comprises a cleaning head removably attached to a handle, said cleaning head having an interior sloping surface which slopes up from two side edges, which are spaced apart from said handle in the direction of movement of said cleaning head, to a central upper extension connector which is removably attached to said handle, said sloping surface being defined by a front wall, a rear wall, and said connector said front wall being closer to and said rear wall being further away from said remote location, said front wall and said rear wall being adapted to substantially conformingly engage at least the lower portions of the front and rear walls of said gutter, respectively, said front wall having an upper sloping lip which extends over the front wall of said gutter, said rear wall having an upper sloping lip which extends towards and over said front wall lip and is in spaced-apart relationship from said front wall lip; each side edge having a substantially flat bottom to engage the bottom interior surface of said gutter and being thin in length; and a handle which is removably attached to said central extension connector of said cleaning head, said handle being of sufficient length to extend from said remote location to said gutter for operation of said device, said sloping surface of said cleaning head being adapted to transfer debris in said gutter from each side edge, up said surface, and over said front wall lip during lateral movement of said cleaning head in said gutter while said rear wall and lip thereof and said central extension connector retain debris on said sloping surface.

2. The hand-held device of claim 1 wherein said handle is pivotably attached to said central extension connector.

3. The hand-held device of claim 1 wherein said handle is adapted about its lower end at said remote location for a hose to be attached thereto, said handle being hollow and capable of having water passed therethrough, said cleaning head also having water ducts therein which run from said central extension connector to openings at each side edge of said head, thereby permitting water to flow up said handle through said cleaning head and out said openings at each side edge for additional cleaning of said gutter.

4. The hand-held device of claim 3 wherein said device has a valve for controlling the flow of water therethrough.

5. The hand-held device of claim 4 wherein said device also has means for directing the water flowing through said head to flow out each side edge separately, or out both side edges simultaneously.

6. The hand-held device of claim 1 wherein said handle is adjustable in length.

7. The hand-held device of claim 1 wherein the front edge of said sloping lip of said rear wall of said cleaning head has a deflector portion which is oriented in the downward direction.

8. The hand-held device of claim 1 wherein said cleaning head and said handle are manufactured from a plastic material.

9. The hand-held device of claim 1 wherein the vertical portion of said rear wall of said cleaning head extends above the horizontal plane of the front edge of the roof adjacent which the gutter is attached prior to said rear wall sloping forward.

* * * * *